US008641479B2

(12) United States Patent
Stephenson

(10) Patent No.: US 8,641,479 B2
(45) Date of Patent: Feb. 4, 2014

(54) TOOL ASSEMBLY FOR MACHINING A BORE

(75) Inventor: David A. Stephenson, Detroit, MI (US)

(73) Assignee: Ford Motor Company, Dearborn, MI (US)

( * ) Notice: Subject to any disclaimer, the term of this patent is extended or adjusted under 35 U.S.C. 154(b) by 645 days.

(21) Appl. No.: 12/873,641

(22) Filed: Sep. 1, 2010

(65) Prior Publication Data

US 2012/0051857 A1 Mar. 1, 2012

(51) Int. Cl.
*B24B 55/02* (2006.01)

(52) U.S. Cl.
USPC ..... 451/53; 451/450; 451/488

(58) Field of Classification Search
USPC ..... 451/450, 488, 21, 61, 548, 541, 53
See application file for complete search history.

(56) References Cited

U.S. PATENT DOCUMENTS 4,129,966 A * 12/1978 Smart et al. ..... 451/359
4,678,738 A 7/1987 Shimizu et al.
4,854,087 A * 8/1989 Riha ..... 451/541
4,887,221 A 12/1989 Davis et al.
5,271,967 A 12/1993 Kramer et al.
5,317,518 A 5/1994 Fujita et al.
5,598,818 A 2/1997 Domanchuk
5,622,753 A 4/1997 Shepley et al.
5,800,252 A * 9/1998 Hyatt ..... 451/61
5,993,297 A * 11/1999 Hyatt et al. ..... 451/53
7,089,662 B2 8/2006 Izquierdo et al.
7,543,557 B2 6/2009 Wang
7,896,728 B2 * 3/2011 Schwartz et al. ..... 451/53
2003/0077464 A1 4/2003 Nomura et al.
2004/0074073 A1 4/2004 Shingai et al.
2007/0190272 A1 8/2007 Kanai et al.
2008/0112659 A1 5/2008 Guerreiro et al.
2010/0031799 A1 2/2010 Ast et al.
2010/0038259 A1 2/2010 Erdmann et al.
2010/0101526 A1 4/2010 Schaefer et al.

FOREIGN PATENT DOCUMENTS

EP 0569926 A1 11/1993
WO 2009071674 A2 6/2009

* cited by examiner

*Primary Examiner* — Robert Rose
(74) *Attorney, Agent, or Firm* — Damian Porcari; Brooks Kushman P.C.

(57) ABSTRACT

A tool assembly for machining a bore. The tool assembly includes a cutting tool and a tool holder. The cutting tool has an abrasive grit disposed continuously around a circumference of the cutting tool. The tool holder has a first coolant passage and a secondary coolant passage that extends at an angle from the first coolant passage.

16 Claims, 2 Drawing Sheets

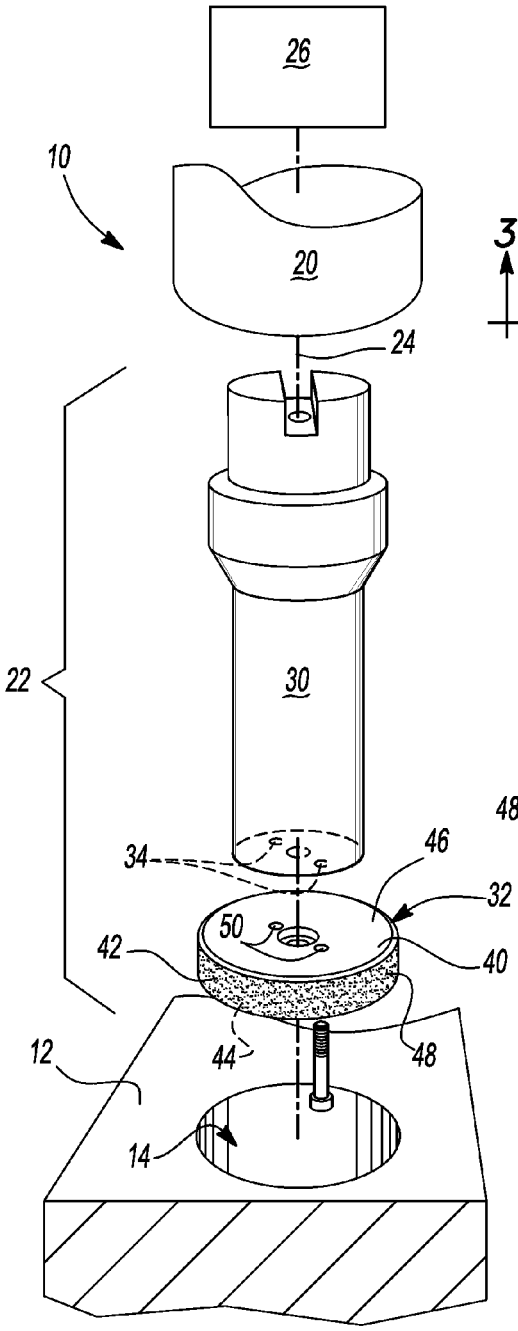
Fig-1
Fig-2
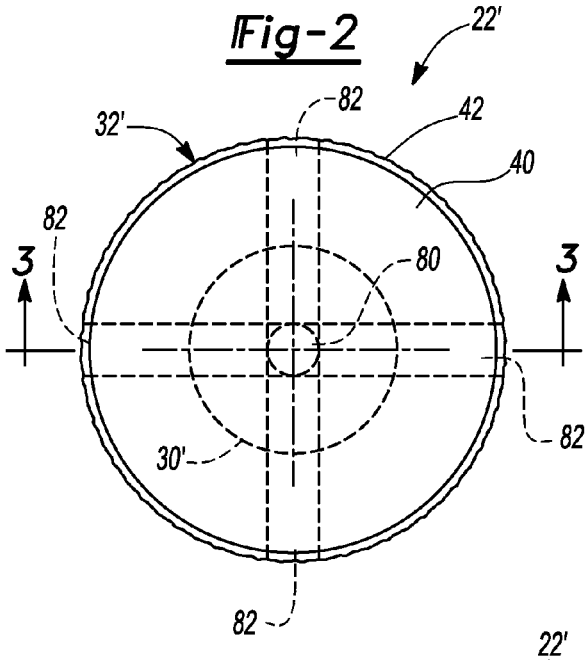
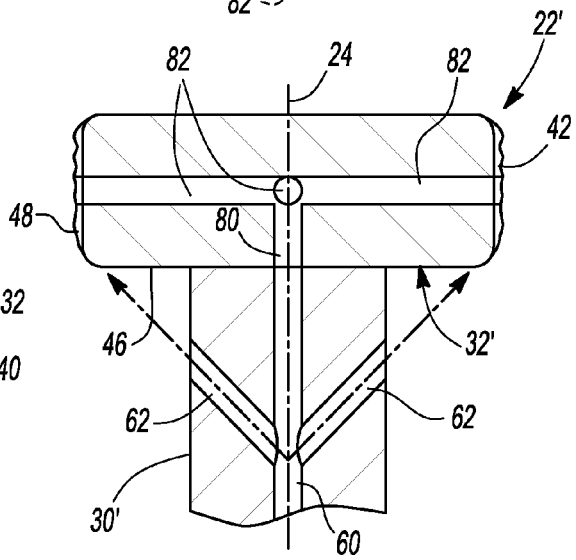
Fig-3

Fig-4
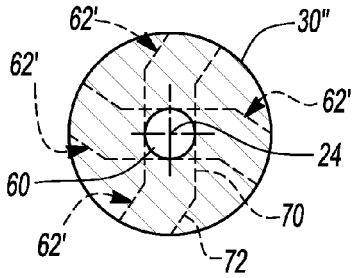
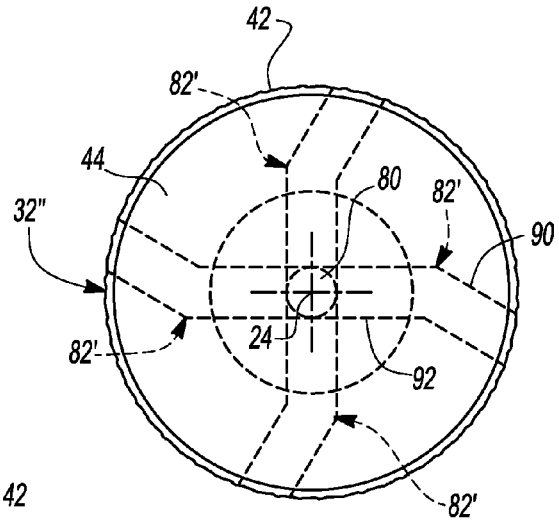
Fig-5
Fig-6
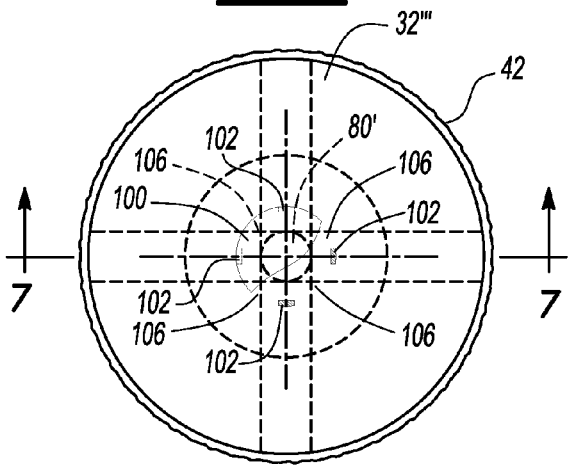
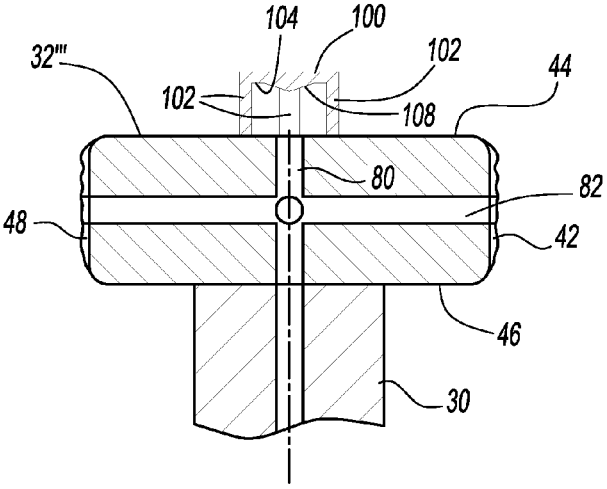
Fig-7
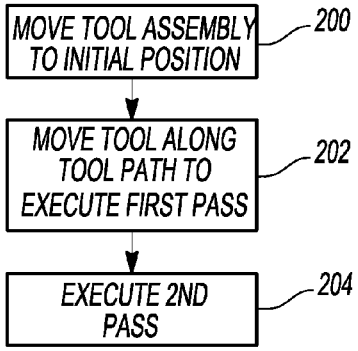
Fig-8

TOOL ASSEMBLY FOR MACHINING A BORE

BACKGROUND

Technical Field

The present invention relates to a tool assembly for machining a bore.

SUMMARY

In at least one embodiment a tool assembly for machining a bore is provided. The tool assembly has a cutting tool and a tool holder. The cutting tool has an abrasive grit disposed continuously around a circumference. The tool holder has a first coolant passage and a secondary coolant passage that extends at an angle from the first coolant passage for spraying coolant toward the cutting tool.

In at least one embodiment a tool assembly for machining a bore is provided. The tool assembly includes a tool holder and a cutting tool disposed on the tool holder. The cutting tool has a first surface, a second surface disposed opposite the first surface, and a third surface extending from the first surface to the second surface that defines a circumference. An abrasive grit is disposed continuously along the circumference. A deflector is disposed on the first surface. The deflector has a deflection surface spaced apart from the first surface for deflecting coolant toward the third surface.

BRIEF DESCRIPTION OF THE DRAWINGS

FIG. 1 is an exploded perspective view of a system for machining a workpiece and a first embodiment of an exemplary tool assembly.

FIG. 2 is a top view of a second embodiment of a tool assembly having a tool holder and a cutting tool.

FIG. 3 is a section view of the tool assembly of FIG. 2 along section line 3-3.

FIG. 4 is a section view of an embodiment of a secondary coolant passage provided with a tool holder.

FIG. 5 is a section view of an embodiment of a secondary tool coolant passage provided with a cutting tool.

FIG. 6 is a top view of another embodiment of a cutting tool.

FIG. 7 is a section view of the tool assembly of FIG. 6 along section line 7-7.

FIG. 8 is a flowchart of a method of machining a bore with a tool assembly.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Referring to FIG. 1, an exploded view of a system 10 for machining a workpiece 12 is shown. The workpiece 12 may be an article having one or more holes or bores 14, such as a cylinder block for an internal combustion engine. In a cylinder block, bores that are configured to receive a piston are called cylinder bores. A thermally sprayed coating may be provided on a rough cast cylinder bore to improve wear resistance. The cylinder bore and its coated surface are machined to achieve a desired surface finish and dimensional characteristics. Diamond honing tools and honing machines have been used to machine cylinder bores due to the high hardness of thermally coated cylinder bores. Such honing machines utilize multiple honing tools for each tool pass, have long cycle times, and high investment cost.

The system 10 may include a spindle 20 and a tool assembly 22. The spindle 20 may be configured to receive the tool assembly 22 and rotate about an axis of rotation 24. The spindle 20 may be driven by a motor and may be disposed on a computer numerically controlled (CNC) machine that may position the tool assembly 22 along multiple axes in a three dimensional space. A coolant source 26 may be associated with the spindle 20 and may be configured to provide pressurized coolant through the spindle 20 to the tool assembly 22 in a manner known by those skilled in the art.

The tool assembly 22 may include a tool holder 30 and a cutting tool 32. The tool holder 30, which may also be called an arbor or a mandrel, may have a generally cylindrical configuration. A first end of the tool holder 30 may be configured to be mounted to the spindle 20. A second end of the tool holder 30 disposed opposite the first end may be configured to receive the cutting tool 32. For instance, the tool holder 30 may include one or more holes 34 that may receive a fastener like a screw to couple the cutting tool 32 to a second end of the tool holder 30. In addition, the tool holder 30 may include one or more coolant passages that receive coolant via the spindle 20 as will be discussed in more detail below.

The cutting tool 32 may include a body 40 and an abrasive grit 42. The body 40 may have a generally cylindrical configuration that may include a first surface 44 and a second surface 46 disposed opposite the first surface 44. A third surface 48 may extend from the first surface 44 to the second surface 46. The third surface 48 may be disposed along a circumference of the body 40. A radius or area of curvature may be provided where the third surface 48 intersects the first surface 44 and/or the second surface 46 to facilitate positioning of the cutting tool 32 into or out of a bore 14. One or more mounting holes 50 may be provided on the body 40 that extend from the first surface 44 to the second surface 46 for receiving a fastener for coupling the cutting tool 32 to the tool holder 30.

The abrasive grit 42 may be disposed on the third surface 48 and may extend continuously around the circumference of the body 40. The abrasive grit 42 may not be disposed on the first and second surfaces 44, 46 in one or more embodiments. The abrasive grit 42 may include a plurality of abrasive particles or grains for removing material from the workpiece 12. For example, the abrasive grit 42 may be electroplated on to a metal disk, or formed into a vitrified bond wheel in one or more embodiments.

Referring to FIGS. 2 and 3, a second embodiment of a tool assembly 22' is shown. The tool assembly 22' may include a tool holder 30' and a cutting tool 32'. The tool holder 30' and cutting tool 32' may be similar to tool holder 30 and cutting tool 32, but may include coolant passages.

The tool holder 30' may include a first coolant passage 60 that receives coolant from the coolant source 26 via the spindle 20. The first coolant passage 60 may supply coolant to one or more secondary coolant passages 62 in the tool holder 30' and to the cutting tool 32'. The first coolant passage may be disposed along the axis of rotation 24.

The secondary coolant passages 62 may extend from the first coolant passage 60 to an external surface of the tool holder 30'. The secondary coolant passages 62 may be disposed at an angle with respect to the first coolant passage 60 and/or the axis of rotation 24. More specifically, the secondary coolant passages 62 may extend at an angle from the first coolant passage 60 toward the cutting tool 32', such as toward a location where the second and third surfaces 46, 48 intersect.

The secondary coolant passages 62 may have a linear configuration, a non-linear configuration, or a combination thereof. In FIG. 3, a linear secondary coolant passage 62 is illustrated.

In FIG. 4, an example of a non-linear secondary coolant passage 62' is shown. More specifically, FIG. 4 is a top section view of an exemplary tool holder 30" from a position located above a set of secondary coolant passages 62'. A secondary coolant passage 62' may include a first portion 70 and a second portion 72. The first portion 70 may extend from the first coolant passage 60 and may have a generally linear configuration in one or more embodiments. The second portion 72 may extend at an angle from an end of the first portion 70 and may also have a generally linear configuration in one or more embodiments. The second portion 72 may extend to an external surface of the tool holder 30" and may be angled toward the cutting tool. In addition, the second portion 72 may be angled in a direction that coincides with a direction in which the tool assembly is rotated about the axis of rotation 24. For instance, the second portion 72 may be angled in the same direction as the tool assembly is rotated to help provide coolant at or in front of a portion of the abrasive grit 42 that engages the bore 14 to help remove particulates and cool the cutting tool.

Referring again to FIGS. 2 and 3, the cutting tool 32' may include a first tool coolant passage 80 and one or more secondary tool coolant passages 82. The first tool coolant passage 80 may be aligned with and receive coolant from the first coolant passage 60 of the tool holder 30'. The one or more secondary tool coolant passages 82 may extend from the first tool coolant passage 80 to the circumference or third surface 48 of the cutting tool 32'. As such, the secondary tool coolant passages 82 may provide coolant to the abrasive grit 42. The secondary tool coolant passages 82 may be disposed in plane in one or more embodiments. In addition, one or more secondary tool coolant passages 82 may be disposed substantially perpendicular to each other and/or to the first tool coolant passage 80. The outlet of the secondary tool coolant passages 82 may be configured as a porous plug or as a hole that is provided without a porous plug in one or more embodiments.

The secondary tool coolant passages 82 may have a linear configuration, a non-linear configuration, or a combination thereof. In FIG. 2, linear secondary coolant passages 82 are illustrated.

In FIG. 5, an example of a non-linear secondary tool coolant passage 82' is shown. The secondary tool coolant passage 82' may include a first portion 90 and a second portion 92. The first portion 90 may extend from the first tool coolant passage 80 and may have a generally linear configuration in one or more embodiments. The second portion 92 may extend at an angle from an end of the first portion 90 and may also have a generally linear configuration in one or more embodiments. The second portion 92 may extend to an external surface of the cutting tool 32". In addition, the second portion 92 may be angled in a direction that coincides with a direction in which the tool assembly is rotated about the axis of rotation 24. As such, the second portion 92 may help provide coolant at or in front of a portion of the abrasive grit 42 that engages the bore 14 to help remove particulates and cool the cutting tool 32".

Referring to FIGS. 6 and 7, another embodiment of a cutting tool 32''' is shown. In this embodiment, the first tool coolant passage 80' extends from the second surface 46 to the first surface 44. A deflector 100 may be disposed on the first surface 44. The deflector 100 may include one or more legs 102 and a deflection surface 104.

The legs 102 may facilitate mounting of the deflector 100 to the first surface 44. The legs 102 may be spaced apart from each other to provide openings 106 through which coolant may pass.

The deflection surface 104 may be configured to redirect coolant exiting the first tool coolant passage 80' outwardly toward the third surface 48 and the abrasive grit 42. The deflection surface 104 may face toward and may be spaced apart from the first surface 44. In addition, the deflection surface 104 may include a deflection feature 108 to help redirect coolant. For example, the deflection feature 108 may be centered above the first tool coolant passage 80' and may have a conical configuration that extends from toward the first surface 44 of the cutting tool 32'''.

Referring to FIG. 8, an exemplary method of machining a bore 14 of a workpiece 12 with a tool assembly is shown. The tool assembly may include any compatible tool holders 30, 30', 30" and cutting tools 32, 32', 32", 32''' previously described. The tool assembly may be disposed on a system 10 having a spindle 20 disposed on a CNC machining center as previously discussed.

At 200, the method may position the tool assembly at an initial position. The initial position may be located along a center axis of a bore and proximate a first end of the bore or bore opening. As such, the cutting tool may not initially engage the workpiece 12. In addition, the tool assembly may be rotated about the axis of rotation 24 by the spindle 20 at any suitable speed, such as between 1000 and 1500 revolutions per minute.

At 202, the system 10 may move tool assembly along a helical tool feed path. The cutting tool may be moved laterally such that the abrasive grit 42 engages a surface of the cylinder bore 14. Then the cutting tool may be moved around the inside diameter of the cylinder bore 14 while being advanced along the length of the cylinder bore 14. As such, the abrasive grit 42 may abrasively remove material from the inside of the cylinder bore as it travels around and along the length of the cylinder bore. The helical path may be determined by a helical interpolation algorithm that may be computed by the CNC machine or provided as a sequence of positioning coordinates. The helical path may be configured such that the abrasive grit 42 travels across or engages the entire surface of the cylinder bore 14.

The helical tool path may also be configured to remove material from a tapered bore that is narrower at one end than another. Such a tool path may be executed by altering the distance the tool assembly moves relative to the center of the bore as it travels along the length of the bore. For instance, the tool may be moved in nominally larger spirals as the bore narrows to compensate for tool bending.

At 204, the tool assembly may execute an optional second pass. A second pass may help provide more uniform bore dimensions. A second path may be executed by following the helical cutting path backwards toward the initial position, thereby executing a "reverse cut" of the bore. If a second pass is not executed, the tool assembly may be moved to a position where it does not contact the bore surface and then retracted out of the bore.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed:

1. A tool assembly for machining a bore, comprising:

a cutting tool having an abrasive grit disposed continuously around a circumference of the cutting tool; and a tool holder disposed proximate the cutting tool, the tool holder having a first coolant passage and a secondary coolant passage that extends at an angle from the first coolant passage for spraying coolant toward the cutting tool;

wherein the secondary coolant passage includes a first portion that extends at an angle from the first coolant passage and a second portion that extends at an angle from the first portion and extends in a direction of rotation of the tool assembly.

2. The tool assembly of claim 1 wherein the first coolant passage is disposed along an axis of rotation of the tool holder and the secondary coolant passage extends toward the circumference of the cutting tool.

3. The tool assembly of claim 1 wherein the secondary coolant passage is linear.

4. The tool assembly of claim 1 wherein the cutting tool includes a first tool coolant passage that is aligned with the first coolant passage and a secondary tool coolant passage that extends at an angle from the first coolant passage to the circumference of the cutting tool.

5. The tool assembly of claim 4 further comprising a plurality of secondary tool coolant passages disposed in a plane, wherein each secondary tool coolant passage is disposed substantially perpendicular to at least one other secondary tool coolant passage.

6. The tool assembly of claim 4 wherein the secondary tool coolant passage has a non-linear configuration.

7. The tool assembly of claim 6 wherein the secondary tool coolant passage includes a first portion that extends from the first tool coolant passage and a second portion that extends at an angle from the first portion.

8. A tool assembly comprising:

a cutting tool disposed on a tool holder and including:

a first surface;

a second surface disposed opposite the first surface;

a third surface extending from the first surface to the second surface that defines a circumference;

an abrasive grit disposed continuously along the circumference; and a deflector disposed on the first surface having a deflection surface spaced apart from the first surface for deflecting coolant toward the third surface.

9. The tool assembly of claim 8 wherein the deflection surface further comprises a deflection feature that extends toward the first surface for deflecting coolant.

10. The tool assembly of claim 9 wherein the deflection feature has a conical configuration.

11. The tool assembly of claim 8 wherein the deflector includes a plurality of legs that engage the first surface, wherein an opening is disposed between the plurality of legs.

12. The tool assembly of claim 8 wherein the cutting tool includes a first tool coolant passage that extends from the first surface to the second surface is configured to spray coolant against the deflector.

13. The tool assembly of claim 12 wherein the cutting tool includes a secondary tool coolant passage that extends from the first tool coolant passage to the third surface.

14. The tool assembly of claim 13 wherein the secondary tool coolant passage has a non-linear configuration.

15. The tool assembly of claim 12 wherein the tool holder includes a first coolant passage configured to provide coolant to the first tool coolant passage and a secondary coolant passage that extends at an angle from the first coolant passage toward the cutting tool.

16. The tool assembly of claim 15 wherein the secondary coolant passage has a non-linear configuration.

* * * * *